US005343218A

United States Patent [19]

Maeda

[11] Patent Number: 5,343,218

[45] Date of Patent: Aug. 30, 1994

[54] METHOD AND APPARATUS FOR FORMING SYNTHESIZED IMAGE

[75] Inventor: Mitsuru Maeda, Yokohama, Japan

[73] Assignee: Canon Kabushiki Kaisha, Tokyo, Japan

[21] Appl. No.: 830,478

[22] Filed: Feb. 7, 1992

Related U.S. Application Data

[63] Continuation of Ser. No. 532,233, Jun. 4, 1990, abandoned, which is a continuation of Ser. No. 932,015, Nov. 18, 1986, abandoned.

[30] Foreign Application Priority Data

Dec. 13, 1985 [JP] Japan ..... 60-281623

[51] Int. Cl.[5] ..... G09G 1/00; G09G 3/00

[52] U.S. Cl. ..... 345/116; 345/115; 345/133; 345/141; 345/185; 345/186; 345/201; 345/203

[58] Field of Search ..... 340/700, 706, 713, 720, 340/721, 723, 732, 751, 752, 789, 791, 798, 799; 358/22, 41, 91, 183, 185; 345/55, 56, 112, 115, 116, 133, 136, 141, 142, 185, 186, 187, 189, 192, 201, 203

[56] References Cited

U.S. PATENT DOCUMENTS

| | | | |
|---|---|---|---|
| 4,019,745 | 4/1977 | Mustelier | 340/799 X |
| 4,228,507 | 10/1980 | Leban | 340/751 X |
| 4,286,329 | 8/1981 | Goertzel et al. | 340/799 X |
| 4,509,043 | 4/1985 | Mossaides | 340/721 |
| 4,511,893 | 4/1985 | Fukuda | 340/751 X |
| 4,517,558 | 5/1985 | Davids | 340/700 |
| 4,528,642 | 7/1985 | Waller | 364/900 |
| 4,573,199 | 2/1986 | Chen et al. | 340/751 X |
| 4,621,340 | 11/1986 | Pokorny et al. | 340/751 X |
| 4,670,841 | 6/1987 | Kostopoulos | 340/751 X |
| 4,672,683 | 6/1987 | Matsueda | 340/799 X |
| 4,739,318 | 4/1988 | Cohen | 340/751 X |

FOREIGN PATENT DOCUMENTS

| | | | |
|---|---|---|---|
| 0074594 | 1/1980 | Japan | 340/751 |
| 0049786 | 4/1980 | Japan | 340/751 |
| 2030335 | 4/1980 | United Kingdom | 340/751 |

OTHER PUBLICATIONS

Sakade et al, *A Guide to Reading and Writing Japanese;* (Chas. E. Tuttle Co.; Rutland, Vt.; 1959; pp. 48 and 89).

Sakade et al, *A Guide to Reading and Writing Japanese,* (Tokyo, 1959); pp. 11–13 and 218.

"Compute's First Book of VIC"; Compute! Books; Greensboro, N.C.; 1982.

*Primary Examiner*—Bernarr E. Gregory

*Attorney, Agent, or Firm*—Fitzpatrick, Cella Harper & Scinto

[57] ABSTRACT

A method and apparatus for forming a synthesized image in a checkerboard (or other) fashion by selecting in turn, from a plurality of different images, data on a predetermined number of picture elements representing the images, taken respectively from first and second image memories. The synthesized image may be composed in a video memory, and can be output to a display, printer or memory unit, for example. The image can also be smoothed by convolution, for example, to avoid formation of Moire-like phenomena in the synthesized image.

28 Claims, 4 Drawing Sheets

START
i, i', i'', j, j' AND j'' ARE INITIALIZED
S41
VM(i,j) ← IM1 (i', j')
VM (i+1, j+1) ← IM1(i'+1, j'+1)
S42
i ← i+2
i' ← i'+2
i'' ← i''+2
S45
VM (i+1,j) ← IM2 (i''+1, j'')
VM (i,j+1) ← IM2 (i'', j''+1)
S43
j = j + 2
j' = j' + 2
j'' = j'' + 2
AND i, i' AND i'' ARE INITIALIZED
S47
i= FINAL VALUE
S44
NO
YES
j= FINAL VALUE
S46
NO
YES
VM'(i, j)= 1/9 Σ VM(i-k, j-ℓ)
k, ℓ=-1
S50
END

FIG. 5

| | | | |
|---|---|---|---|
| | VM(i-1, j-1) | VM(i, j-1) | VM(i+1, j-1) |
| | VM(i-1, j) | VM(i, j) | VM(i+1, j) |
| | VM(i-1, j+1) | VM(i, j+1) | VM(i+1, j+1) |
| | | | |

METHOD AND APPARATUS FOR FORMING SYNTHESIZED IMAGE

This application is a continuation of application Ser. No. 07/532,233 filed Jun. 4, 1990, which is a continuation of application Ser. No. 06/932,015, filed Nov. 18, 1986, both now abandoned.

BACKGROUND OF THE INVENTION

1. Field of the Invention

The present invention relates to a method and apparatus for forming a synthesized image which is capable of combining a plurality of images and outputting a resultant synthesized image to an image display device or a printer, or of storing it in a memory unit.

2. Description of the Prior Art

Conventionally, various methods of combining a plurality of images and outputting the results have been proposed. Image synthesis or the multiplex output of a plurality of images to one picture screen has been commonly practiced lately in a wide range of areas, including high-performance workstation and home-use personal computers.

With conventional methods, when a plurality of images, e.g., two images, are combined and output from an output device such as a display device, overlapped parts of the synthesized image are each selectively constituted by the part representing the most significant image, i.e., it is impossible to leave a space for a subordinate image in the overlapping part and see it through that space.

SUMMARY OF THE INVENTION

Accordingly, an object of the present invention is to provide a method and apparatus for forming a synthesized image which can eliminate the problem described above.

In one embodiment, the present invention provides a method and apparatus which are capable of forming a checkerboard pattern of a synthesized image from a plurality of images (throughout the specification, abstract and claims, the phrase "in checkerboard fashion" means "in a two-dimensional array comprising a plurality of lines and, transverse to the lines, a plurality of columns, each line and each column having a plurality of regions of one type and a plurality of regions of a second type alternating in both directions with the regions of the one type").

In another embodiment, the invention further provides a method and apparatus which are capable of eliminating the Moire-like dot pattern which may be generated when dot images are combined.

Other objects of the present invention will become clear from the following description taken in conjunction with the accompanying drawings.

BRIEF DESCRIPTION OF THE DRAWINGS

FIG. 5 shows the allocation of memory cells in a video memory.

DESCRIPTION OF THE PREFERRED EMBODIMENT

Figure 1:
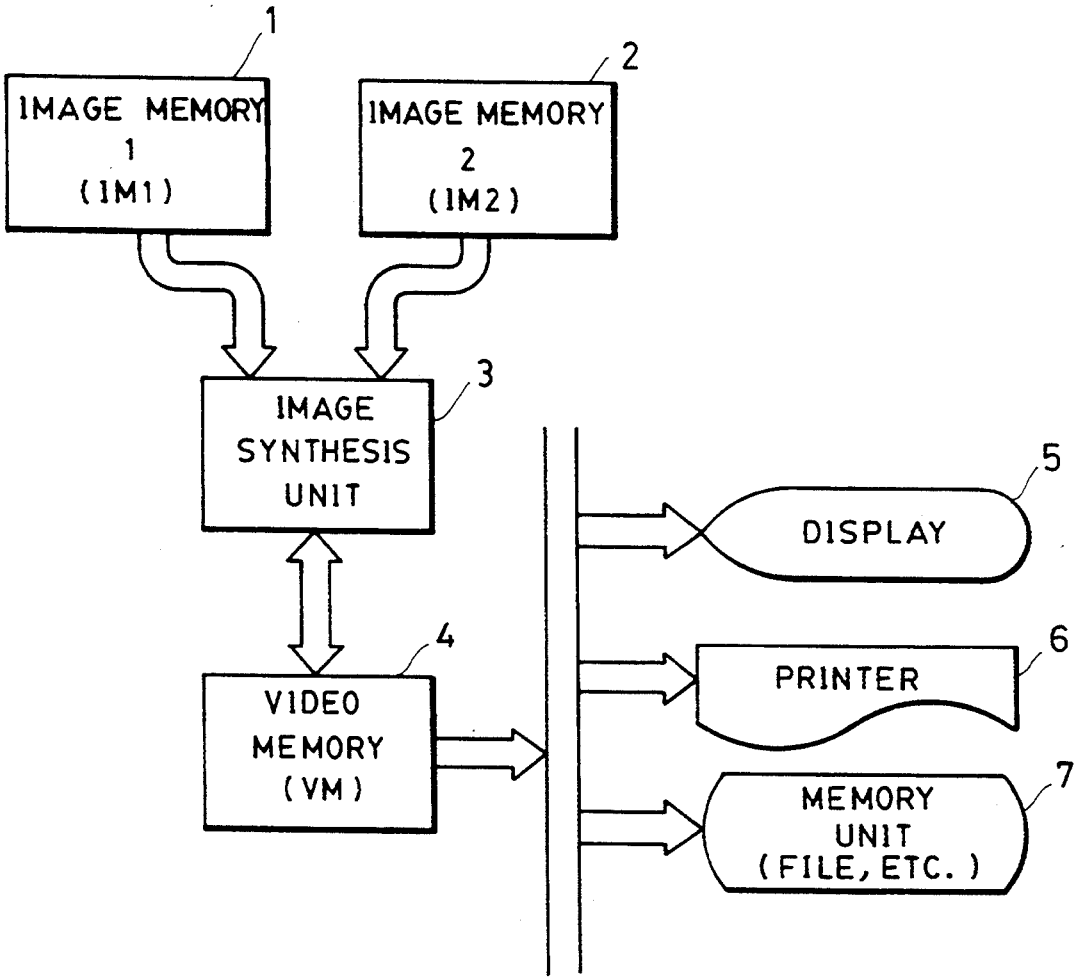
FIG. 1 is a block diagram of an image synthesizing apparatus.

FIG. 1 shows an embodiment of an image synthesizing apparatus according to the present invention, which is capable of synthesizing an image in a checkerboard fashion from two images. The image synthesizing apparatus includes image memories 1, 2 each of which stores one image, an image synthesis unit 3 for synthesizing an image in a checkerboard fashion, and a video memory 4 for storing a synthesized image which is to be output to a display device 5 or a printer 6, or which is to be stored in a memory unit 7.

The image synthesis unit 3 uses two methods for storing picture elements in the video memory 4: a first method in which picture elements constituting the images stored in the image memories 1, 2 are selectively stored in the video memory 4; and a second method in which a picture element of an image which has been stored in the video memory 4 is smoothed by performing a convolution on that picture element and the picture elements located adjacent thereto, the result again being stored in the video memory 4.

The first method will be described below in detail, under the assumption that the memories 1 and 2 store data representing picture elements in such a way that it can be regarded as a two-dimensional array.

Figure 2:
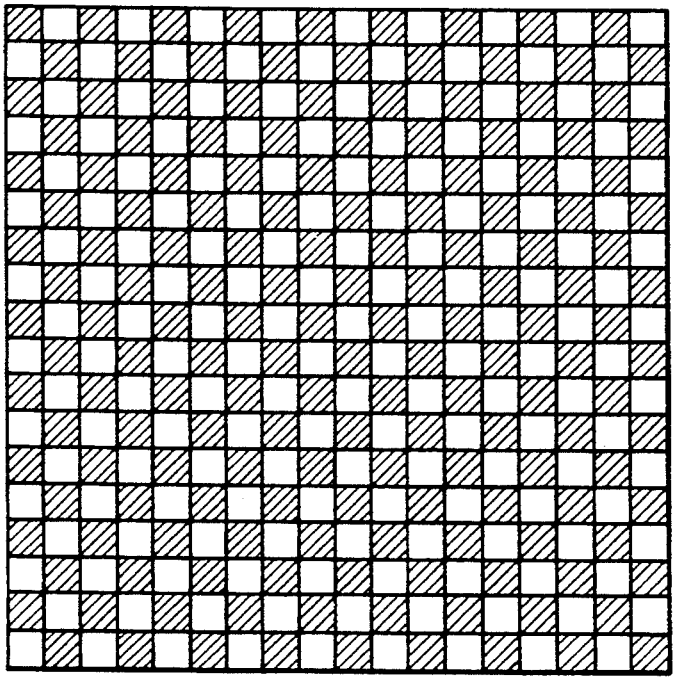
FIG. 2 shows a checkerboard pattern used to explain an embodiment of the present invention.

In the picture image synthesis, data is selected from two images in groups of at least one picture element to form a synthetic image of a checkerboard pattern, as shown in FIG. 2. For convenience of description, it is assumed that each constituent of the checkerboard corresponds to one picture element, i.e., that each of the squares in the pattern shown in FIG. 2 corresponds to one picture element in the video memory 4, and the hatched squares contain data constituting picture elements stored at the corresponding positions in the image memory 1, while the blank squares contain data constituting picture elements stored at the corresponding positions in the image memory 2.

Figure 3:
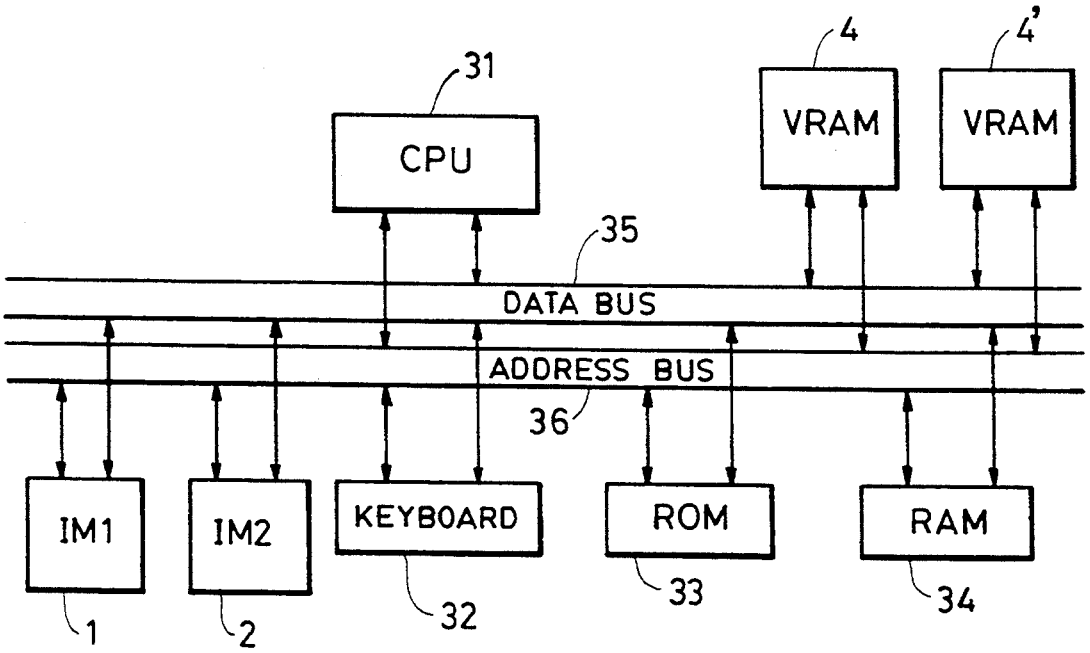
FIG. 3 is a circuit diagram of an image synthesis unit.
Figure 4:
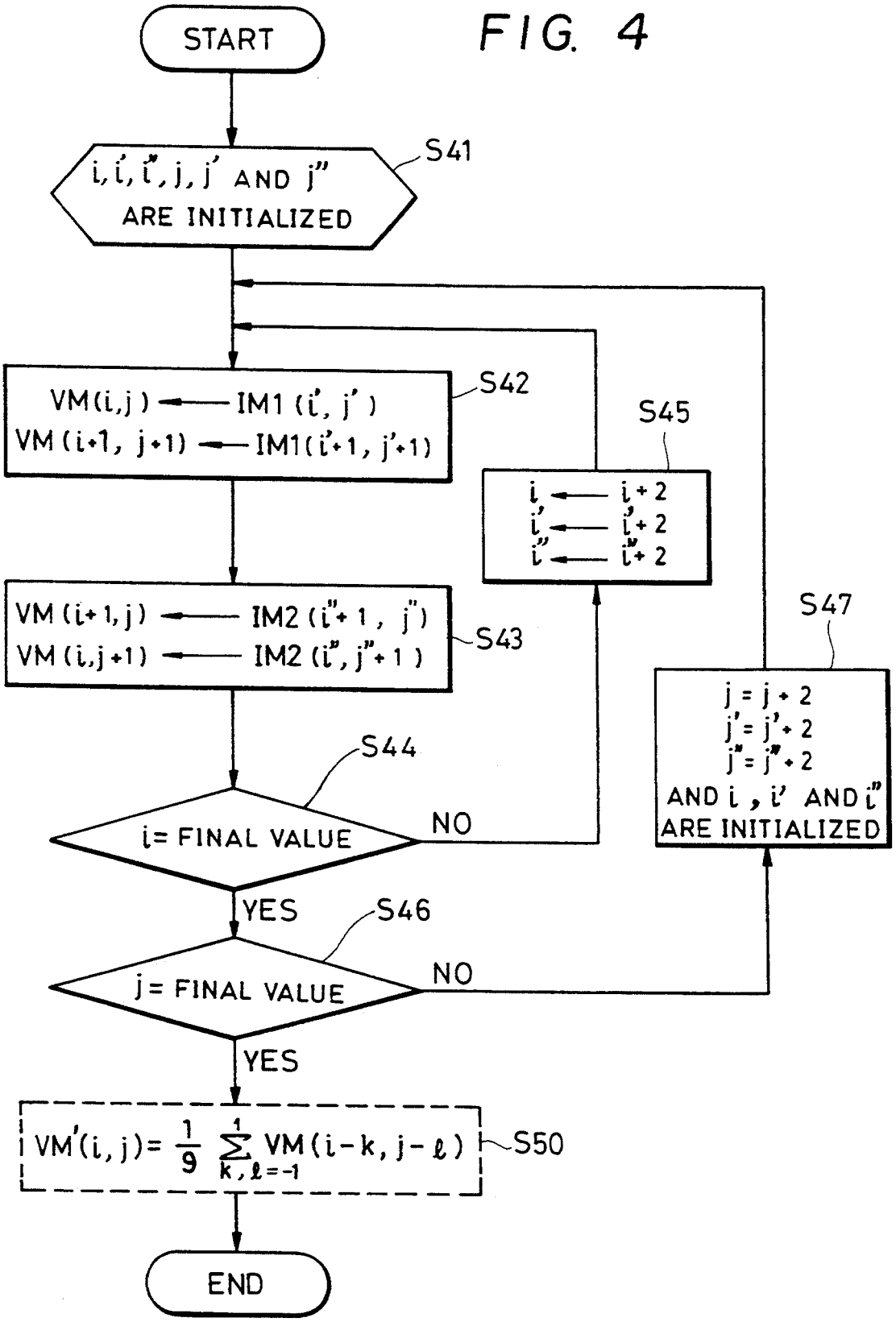
FIG. 4 is a flowchart of an embodiment of a first method of synthesizing an image.

FIG. 3 is a circuit diagram of the image synthesis unit 3. The image synthesis unit comprises a CPU 31 which performs an image synthesis operation, a keyboard 32 from which coordinates of a synthesized image or of picture elements in the two original images to be combined are input and from which various instructions are given, a ROM 33 which stores an operational program which is shown in FIG. 4, and a RAM 34 which temporarily stores data required for the operations conducted by the CPU 31.

The operation of the image synthesis unit will be described hereinbelow with reference to the program flowchart shown in FIG. 4.

The operation starts by inputting initial values for i, i', i'', j, j', and j'' from the keyboard in step 41, where (i, j) designate the coordinates in the video memory 4 at which the selected data is stored, while (i', j') and (i'', j'') denote the coordinates in the image memories 1 and 2, respectively. VM(i, j) denotes data values of a picture element to be stored in the video memory 4, while IM1 (i', j') and IM2 (i'', j'') denote data values of picture elements which have been stored in the image memories 1, 2, respectively. In step 42, IM1 (i', j') and IM1(i'+1, j'+1) are stored in VM(i, j) and VM(i+1, j+1), respectively. Then, in step 43, IM2(i''+1, j'') and IM2 (i'', j''+1) are stored in VM(i+1, j) and VM(i, j+1), respectively. Subsequently, i, i' and i'' are each incremented by two, and the same operations are repeated. This set of operations is repeated until one scan, in which two lines are scanned at the same time in the first direction (in steps 42 to 45), is completed. In step 47, the values of j, j' and j'' obtained when one scan in the main direction has been completed are each incremented by two, and i, i', i'' are initialized ready to scan the next two lines. All the remaining lines are then scanned in this way to complete the processing of the specified image area.

With the arrangement described above, it is possible to synthesize an image in such a manner that it forms a checkerboard pattern with its constituent adjacent picture elements being selected from different images, as shown in FIG. 2, and stored in the video memory 4. The data stored in the video memory 4 may then be displayed on the display device 5, recorded by the printer 6, or stored in the memory unit 7.

The second method of forming a synthesized image by image synthesis unit will be described next. When original dot images are combined into a dot image, Moire patterns are generated owing to distortions of spatial frequencies. If the dot images are combined by the first method, the resultant synthesized image therefore has intruding patterns which resemble Moire patterns, and which reduce the image quality. In order to remove these patterns, the resultant synthesized image is smoothed by means of convolution.

FIG. 5 shows the allocation of memory cells in the video memory 4. Convolution is performed on, for example, VM(i, j) and the eight picture elements located adjacent thereto. Data representing the picture element to be smoothed, VM'(i, j), can be obtained by the following equation:

$$VM'(i, j) = \frac{1}{9} \sum_{k,l=-1}^{1} VM(i-k, j-l) \quad (1)$$

The thus-obtained data VM'(i, j) is then stored in another video memory 4'.

The operation expressed by equation (1) is performed on all data (i, j) stored in the video memory 4 in step 50, after step 46 is executed.

At that time, if there are no peripheral picture elements for VM (i, j), the missing picture element is substituted from the picture element located adjacent thereto or the data VM(i, j).

If there are a plurality of images to be combined, a predetermined number of picture elements can be output from each of the picture images in turn for each picture element group.

In the embodiment described above, picture elements stored in the video memory 4 form a checkerboard pattern. If their phases are the same, it is possible to form a striped pattern.

Each constituent of the checkerboard obtained in the above-described embodiment corresponds to one picture element. If the units of the numbers of picture elements to be selected from each of the image memories 1 and 2 are independent of each other, it is possible to express depth by the synthesized image.

In the embodiment described above, two images are combined in a checkerboard fashion. However, it is possible to synthesize an image from three or more images.

As will be understood from the foregoing description, according to the present invention, an image can be synthesized from a plurality of images by a simple method in which picture elements are selected from each of those images in groups of picture elements.

This invention has been described with reference to a preferred embodiment. Obvious modifications and alterations may be made without departing from the spirit and scope of the invention as set forth in the appended claims.

What is claimed is:

1. A method of forming a synthesized image, comprising the steps of: preparing a plurality of different image signals representing a plurality of images; selecting picture elements, in groups of a first predetermined number of picture elements, from a first of said image signals and in groups of a second predetermined number of picture elements from a second of said image signals, in turn, in a sequence, with a group of picture elements from the first image signal between each two consecutive groups from the second image signal, and with a group from the second image signal between each two consecutive groups from the first image signal; and repeating said selecting, in said sequence, to form a synthesized image having a plurality of lines, each line containing a plurality of such groups of picture elements from each said image signal.

2. A method of forming a synthesized image according to claim 1, wherein the positions of the picture elements to be selected are shifted each n lines, where n is one of said first and second predetermined numbers.

3. A method of forming a synthesized image according to claim 1 further including a step of smoothing said synthesized image after it has been formed.

4. A method of forming a synthesized image according to claim 1, wherein said plurality of image signals are two image signals, said two image signals being alternately selected in said selecting step.

5. A method of forming a synthesized image according to claim 1, wherein the synthesized image is formed in a checker-board fashion.

6. A method according to claim 1, wherein said first and second predetermined numbers are equal.

7. An apparatus for forming a synthesized image, said apparatus comprising: a first generating means for generating a first image signal; a second generating means for generating a second image signal; a selecting means for selecting the first image signal and the second image signal, in turn, as groups of a first predetermined number of the constituent picture elements of the first image signal and groups of a second predetermined number of the picture elements of the second image signal, to produce a synthesized signal representing, in each line of image, a plurality of such groups of the picture elements from the first image signal and a plurality of such groups of picture elements from the second image signal, with one such group of picture elements from the first image signal between each two consecutive groups of picture elements from the second image signal, and with one such group of picture elements from the second image signal between each two consecutive such groups from the first image signal; and an output means for outputting the synthesized signal synthesized by said selection means.

8. An apparatus for forming a synthesized image according to claim 7, wherein said output means is a display device which displays said synthesized signal.

9. An apparatus for forming a synthesized image according to claim 7, wherein said output means is a printer which records said synthesized signal.

10. An apparatus for forming a synthesized image according to claim 7, wherein said output means is a memory unit which stores said synthesized signal.

11. An apparatus for forming a synthesized image according to claim 7 further including a means for smoothing said synthesized signal.

12. An apparatus according to claim 7, wherein said first and second predetermined numbers are equal.

13. An apparatus for forming a synthesized image, said apparatus comprising:

a first image memory for storing a first image having plural rows of picture elements;

a second image memory for storing a second image having plural rows of picture elements;

a video memory; and means for selectively storing in said video memory groups of picture elements in turn corresponding to the images stored in said first image memory and in said second image memory, each selectively-stored group of picture elements of the first image having a first predetermined number of picture elements and each selectively-stored group of picture elements of the second image having a second predetermined number of picture elements, and for repeating said selective storing to form a synthesized image which includes a plurality of such groups of picture elements from each of said image memories, with one such group of picture elements from the first image between each two consecutive groups of picture elements from the second image, and with one such group of picture elements from the second image between each two consecutive such groups from the first image.

14. Apparatus for forming a synthesized image according to claim 13, wherein the synthesized image is formed in a checkerboard fashion.

15. An apparatus according to claim 13, wherein said first and second predetermined numbers are equal.

16. A method of synthesizing an image from first and second images respectively, comprising the steps of:

storing a first image including a plurality of first partial images in a first image memory;

storing a second image including a plurality of second partial images in a second image memory;

selecting each of the plurality of first partial images and the plurality of second partial images;

storing each of the plurality of first partial images and each of the plurality of second partial images in a video memory under first and second memory addresses of the video memory, respectively; and repeating said selecting step and said storing step to synthesize an image in which each of the plurality of first partial images and each of the plurality of second partial images are arranged not to be next to each other in the video memory.

17. A method of forming a synthesized image according to claim 16, wherein the synthesized image is formed in a checkerboard fashion.

18. A method according to claim 16, wherein the plurality of first partial images and the plurality of second partial images include a plurality of dots.

19. A method according to claim 16, wherein the first memory address alternates with the second memory address.

20. A method of synthesizing an image, comprising the steps of:

preparing a plurality of image signals including a plurality of picture elements;

selecting each of the plurality of picture elements from one of the plurality of image signals;

storing each of the plurality of picture elements of one of the plurality of image signals and each of the plurality of picture elements of another of the plurality of image signals under first and second memory addresses of the video memory, respectively, said first and second memory addresses being arranged not to be next to each other; and repeating said selecting step and said storing step to synthesize an image in which image elements from a same image signal are arranged not to be next to each other.

21. A method according to claim 20, wherein the plurality of first partial images and the plurality of second partial images include a plurality of dots.

22. A method according to claim 20, wherein the first memory address alternates with the second memory address.

23. An apparatus for forming a synthesized image, said apparatus comprising:

first generating means for generating a first image signal including a plurality of first partial images;

second generating means for generating a second image signal including a plurality of second partial images;

a video memory; and memory controlling means for storing each of the plurality of first partial images and each of the plurality of second partial images under first and second memory addresses of said video memory, respectively.

24. An apparatus according to claim 23, wherein the plurality of first partial images and the plurality of second partial images include a plurality of dots.

25. An apparatus according to claim 23, wherein the first memory address alternates with the second memory address.

26. An apparatus for forming a synthesized images, said apparatus comprising:

first image memory means for storing a first image including a plurality of first partial images;

second image memory means for storing a second image including a plurality of second partial images;

a video memory; and controlling means for storing each of the plurality of first partial images and each of the plurality of second partial images under first and second memory addresses in said video memory, respectively.

27. An apparatus according to claim 26, wherein the plurality of first partial images and the plurality of second partial images include a plurality of dots.

28. An apparatus according to claim 20, wherein the first memory address alternates with the second memory address.

* * * * *

UNITED STATES PATENT AND TRADEMARK OFFICE

CERTIFICATE OF CORRECTION

PATENT NO. : 5,343,218

DATED : August 30, 1994

INVENTOR(S) : MITSURU MAEDA

It is certified that error appears in the above-identified patent and that said Letters Patent is hereby corrected as shown below:

ON THE TITLE PAGE

*Attorney, Agent, or Firm* — "Fitzpatrick, Cella Harper & Scinto" should read --Fitzpatrick, Cella, Harper & Scinto--.

COLUMN 4

Line 38, "checker-board" should read --checkerboard--.

COLUMN 5

Line 5, "claim 7" should read --claim 7,--.
Line 36, "Apparatus" should read --An apparatus--.

COLUMN 6

Line 46, "images," should read --image,--.
Line 61, "claim 20," should read --claim 26,--.

Signed and Sealed this

Thirty-first Day of January, 1995

*Attest:*

Bruce Lehman

BRUCE LEHMAN

*Attesting Officer*

*Commissioner of Patents and Trademarks*